US010415922B2

(12) United States Patent
Reik

(10) Patent No.: US 10,415,922 B2
(45) Date of Patent: Sep. 17, 2019

(54) SUPPORT ADAPTER SYSTEM FOR FIREARMS

(71) Applicant: Robert Reik, Sacramento, CA (US)

(72) Inventor: Robert Reik, Sacramento, CA (US)

( * ) Notice: Subject to any disclaimer, the term of this patent is extended or adjusted under 35 U.S.C. 154(b) by 0 days.

(21) Appl. No.: 15/789,954

(22) Filed: Oct. 20, 2017

(65) Prior Publication Data

US 2018/0112947 A1 Apr. 26, 2018

Related U.S. Application Data

(60) Provisional application No. 62/410,546, filed on Oct. 20, 2016.

(51) Int. Cl.
*F41A 23/18* (2006.01)
*F41A 23/12* (2006.01)

(52) U.S. Cl.
CPC ..... *F41A 23/18* (2013.01); *F41A 23/12* (2013.01)

(58) Field of Classification Search
CPC ..... F41A 23/18; F41A 23/12; F41A 23/14; F41A 23/16; F41A 23/04; F41A 23/06; F41A 23/08; F41A 23/10; F41A 23/52
USPC ..... 42/94, 106
See application file for complete search history.

(56) References Cited

U.S. PATENT DOCUMENTS 8,549,786 B1 * 10/2013 Griffith ..... F41A 23/16 42/94
8,931,201 B2 * 1/2015 Gianladis ..... F41A 23/18 42/94
2006/0175482 A1 * 8/2006 Johnson ..... F16M 11/14 248/176.1
2010/0102178 A1 * 4/2010 Smith ..... F16M 11/04 248/122.1
2012/0255212 A1 * 10/2012 Werner ..... F41A 23/18 42/90
2012/0273631 A1 * 11/2012 Deros ..... F16M 11/041 248/122.1
2012/0294672 A1 * 11/2012 Hicks ..... F16M 11/04 403/299
2014/0036519 A1 * 2/2014 Cloward ..... F21V 21/22 362/418
2014/0182184 A1 * 7/2014 Gianladis ..... F41A 23/18 42/94
2015/0286116 A1 * 10/2015 Johnson, Sr. ..... G03B 17/568 348/373
2016/0265872 A1 * 9/2016 Tarazi ..... F41C 27/22
2016/0273865 A1 * 9/2016 Banes ..... F16M 13/02
2017/0115080 A1 * 4/2017 Boettner ..... F41A 3/66
2017/0153084 A1 * 6/2017 Tarazi ..... F41C 23/12
2017/0314729 A1 * 11/2017 Torbitt ..... F21V 33/008

* cited by examiner

*Primary Examiner* — Joshua E Freeman
(74) *Attorney, Agent, or Firm* — Hyungsoo Ahn

(57) ABSTRACT

Embodiments for a support and apparatus system for firearms are provided. The system includes a tripod adapter base, a machined magazine well block shaped to fit inside the magazine well of a firearm, magazine well blocks that have identical magazine release features of an actual firearm magazine, a magnetic container apparatus, and various attachment mechanisms including electrical power supplies for powering lights, lasers, and mobile phones.

10 Claims, 8 Drawing Sheets

SUPPORT ADAPTER SYSTEM FOR FIREARMS

CROSS-REFERENCE TO RELATED APPLICATIONS

This application claims priority to U.S. Provisional Application No. 62/410,546 filed on Oct. 20, 2016. The content of the above application is incorporated by reference in its entirety.

FIELD OF THE DISCLOSURE

This disclosure relates generally to the field of firearms maintenance, repair, and servicing. More specifically, this disclosure relates to a support adapter system for firearms.

BACKGROUND

Proper and routine weapon maintenance and inspection of a firearm are essential to ensure maximum reliability of that firearm. However, servicing a firearm without proper tools or platforms can lead to insufficient and ineffective servicing, which could lower the overall accuracy, durability, and reliability of that firearm. Currently, firearms are serviced by being disassembled and laid out on a bench or table or secured via vice grips, limiting motion to fixed, linear positions. Additionally, after disassembly, a user generally has to hold the firearm (which can be heavy) by hand and manipulate the position of the firearm in order to perform and execute a thorough maintenance or servicing. This means positional maneuvering is done with one hand and the actual cleaning is done with another hand, which can lead to body strain and fatigue, which can make the entire process inefficient, tiresome, and drawn-out.

The use of a vice grip secured to a larger, horizontal platform will allow a hands-free approach in that the user no longer has to hold the firearm in his or her hands, but a vice grip holds the firearm in one fixed position at a time when tightened. One fixed position does not "fit all" when it comes to servicing a firearm, and the only way to hold the firearm in a desired position using a vice grip is to loosen the grip, remove the firearm, change the position of the firearm, reinsert the firearm, and finally re-tighten the grip. This process can also become inefficient, tiresome, and drawn out.

U.S. Pat. No. 9,228,800 describes using a platform with multiple grooves and receivers to mount firearms or firearm parts in a fixed position. The grooves and receivers are generally built into a platform that can be of many sizes with various connectors for different styles of firearms. This patent discloses multiple variations of this platform configuration, but this solution still suffers from one or more of the problems described above, specifically in regards to using the platform in areas where no tables or flat surfaces are available.

Thus, there is a need for an effective and efficient system and adapter for firearms maintenance, repair, and servicing that can be used anywhere without the need for a table or a flat surface.

SUMMARY

In one aspect, a support system and apparatus for firearms is presented herein according to one or more embodiments. In one non-limiting embodiment, the system may include a tripod adapter base for a photography or videography stand such as a tripod, a magazine well block wherein the magazine well block comprises a block body, wherein the block body comprises at least one relief cavity, wherein the at least one relief cavity is identical to a relief cavity found on a functional firearm magazine, and wherein the block body comprises a solid, filled construction such that live ammunition cannot be loaded into the magazine well block and a firearm cannot be fired when said magazine well block is inserted into a magazine well of a firearm. Additionally, according to one or more embodiments, the system may feature a block body with a skeletonized construction such that live ammunition cannot be loaded into the magazine well block and a firearm cannot be fired when said magazine well block is inserted into a magazine well of a firearm.

In some embodiments, the system may include a tripod adapter base for a photography or videography stand such as a tripod, a magazine well block, a vessel, and a magnet, wherein the magazine well block comprises a block body, wherein the block body comprises at least one relief cavity, wherein the at least one relief cavity is identical to a relief cavity found on a functional firearm magazine, wherein the block body comprises a solid construction such that live ammunition cannot be loaded into the magazine well block and a firearm cannot be fired when said magazine well block is inserted into a magazine well of a firearm, wherein the vessel comprises a ferrous metal, and wherein the magnet is attached between the vessel and the tripod adapter base such that the magnet magnetizes the vessel. Additionally, the vessel may include a tray or a bowl according to one or more embodiments.

The preceding and following embodiments and descriptions are for illustrative purposes only and are not intended to limit the scope of this disclosure. Other aspects and advantages of this disclosure will become apparent from the following detailed description.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DEFINITIONS

Figure 1:
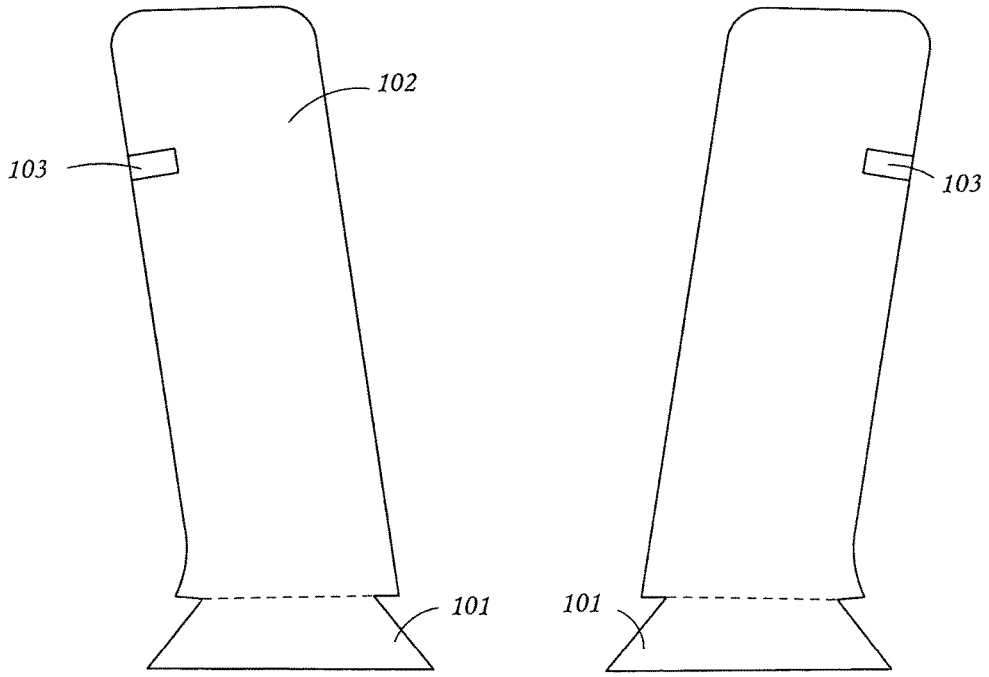
FIG. 1 shows a side view of a magazine well block and tripod adapter base according to embodiments of the present disclosure.

As used in the present disclosure, the following terms are to be attributed the meanings assigned in this section and listed below:

"Firearm" refers to any rifle, pistol, or other portable gun.

"Magazine" refers to the detachable ammunition storage and feeding device such as a cartridge that is inserted or attached to a firearm.

"Magazine well" refers to the cavity or space into which a detachable magazine is inserted.

"Magazine well block" refers to the manufactured block of one or more embodiments of the system that is machined and shaped like the actual magazine of a particular firearm but is incapable of housing live ammunition of any kind.

"Block" refers to any solid piece of material.

"Tripod" refers to a three legged frame generally used as a portable platform to support weight and maintain stability of another object.

"Unibody" refers to a unitized body or unitary construction design where components form a single structure.

"Screw-type" refers to the type of adapter with a female threaded receiver to receive a male threaded screw of a photography/videography tripod the way the base of a camera connects to a screw-type tripod head.

"Clamp-type" refers to the type of adapter that uses a clamp to be secured to the head of a tripod with a corresponding clamp head.

"Mesh screen" refers to a barrier made of flexible or ductile material such as metal or fibers and generally resembles a web or a net.

"Skeletonized" refers to an object that has been machined, formed, or manufactured to resemble a skeleton or possible skeleton-like structure of the object.

"Computer Numerical Control (CNC)" refers to a milling process of cutting various materials through a computer controlled or assisted machine.

"Laser cutting" refers to the process or technology of cutting various materials with a laser.

DETAILED DESCRIPTION

In the Summary above, this Detailed Description, the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose limit is the second number. For example, 25 to 100 mm means a range whose lower limit is 25 mm and upper limit is 100 mm.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

Embodiments in the present description are generally directed to a support and apparatus system for firearms 701. The one or more embodiments may be used for any type of firearm 701 or photography/videography stand known in the art or yet to be developed. This includes new and old (modern and traditional) firearms and photography/videography tripods.

Turning now to FIG. 1, in one or more non-limiting embodiments, the system 100 may include the adapter base 101 is attached to a magazine well block 102 that has release mechanisms 103 that function similarly to release mechanisms 103 on an actual ammunition magazine of a firearm. One or more non-limiting embodiments feature an adapter that attaches to any clamp or screw-type 301 structure, preferably a photography/videography tripod, which allows the user to utilize the tripod as a stable and safe platform for the hands free maintenance, cleaning, lubrication, and bore sighting of a specific firearm 701. Other embodiments feature a variety of magazine well blocks 102 that can be used with many different types of firearms 701 by molding and manufacturing the magazine well block 102 to the precise shape, outline, or size specifications and dimensions of a specific firearm, such as a handgun or a rifle. Although the magazine well block 102 may have identical release mechanisms 103 as those found on an actual ammunition magazine of a particular firearm, the magazine well block 102 is incapable of holding live ammunition rounds of any kind in any capacity. As a result, once the magazine well block 102 is inserted into the empty magazine well of a firearm, said firearm cannot be fired, which makes the system 100 safe to use at all times.

Figure 2A:
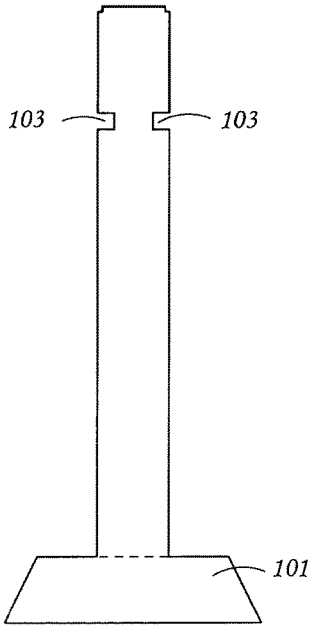
FIG. 2A shows a front view of a magazine well block with release mechanisms and tripod adapter base according to embodiments of the present disclosure.

FIG. 2A shows a front view of one embodiment of the magazine well block 102 with release mechanisms 103. Molding and manufacturing the magazine well blocks 102 to the precise specifications of a specific firearm will allow a user to connect any corresponding firearm securely to the adapter system. One embodiment may features magazine well blocks 102 that are machined to look and replicate the release mechanisms 103 of an actual firearm magazine or cartridge such grooves, notches, cutouts, and tabs for added stability and security. The magazine well blocks 102 may be solid or skeletonized to prohibit the housing of live ammunition rounds to ensure safety during use.

Figure 2B:
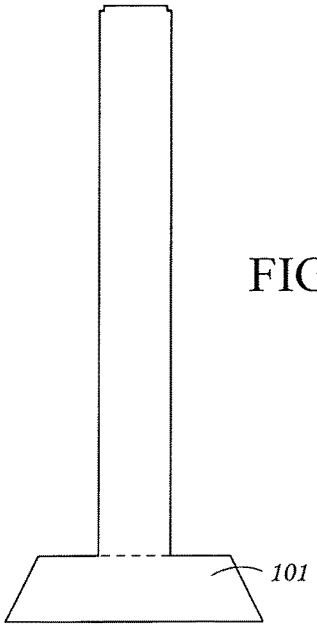
FIG. 2B shows a front view of a magazine well block and tripod adapter base according to embodiments of the present disclosure.

FIG. 2B shows a front view of one embodiment of the magazine well block 102 without any release mechanisms. However, because of the identical dimensions of an actual magazine of a firearm, the magazine well block 102 and tripod adapter base 101 can still be used securely and effectively. With the firearm securely positioned, a user may proceed with the maintenance, repair, service, displaying, or building of firearms while having the versatility, portability, and stability of a photography/videography tripod. As a result, the magazine well block 102 can be inserted and securely locked into the magazine well of a matching firearm, which allows the user to maintain, repair, service, display, and build firearms while having the versatility, portability, and stability of a photography/videography tripod 103 with the safety provided by the magazine well block 102 preventing the use, loading, or chambering of live ammunition.

Figure 3A:
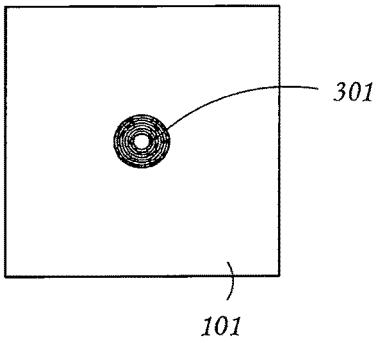
FIG. 3A shows a bottom view of a tripod adapter base with a screw-type adapter according to embodiments of the present disclosure.
Figure 3B:
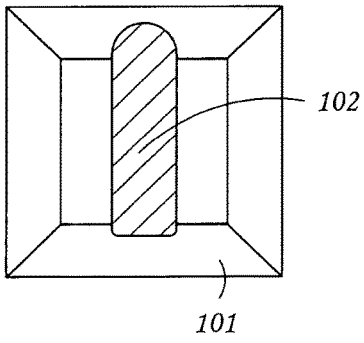
FIG. 3B shows a top view of a magazine well block and tripod adapter base according to embodiments of the present disclosure.

FIG. 3A shows a bottom view of a tripod adapter base 101 with a screw-type adapter 301. In other embodiments, a clamp-type adapter may be used. The screw-type adapter 301 is preferred because it is the most common configuration amongst tripod heads, but other adapter types may be used. FIG. 3B shows a top view of the tripod adapter base 101 with a magazine well block 102 and a screw type adapter 103 as shown in FIG. 3A. In one or more embodiments, the user can use the a tripod adapter base 101 with any compatible tripod attached to service firearms at home on a desk with the tripod's legs collapsed and shortened, on the ground with the legs extended, or easily take the whole system to the gun range or outdoors for on-sight firearm servicing or displaying. Another embodiment features an adapter base 101 that can be attached to stationary platforms such as a table or a wall.

The magazine well block is preferably molded and machined down to form a male connection for the female magazine well or cavity of virtually any gun type or model. The magazine well block can be made from different materials, such as composite plastics or polymer plastics such as polypropylene, through injection molding. One embodiment features a magazine well block with a low density polypropylene through computer numerical control (CNC) milling. Other embodiments feature magazine well blocks machined and manufactured from various metals including steel. One or more embodiments feature magazine well blocks 102 with the proper or identical magazine release mechanisms and design features such as grooves, tabs, cutouts, and notches which allows the magazine well block 102 to accept the firearm's magazine lock and corresponding release mechanism located within the firearm's magazine well to be connected to and controlled by a magazine release button of a firearm. This ensures a shape that allows the magazine well block 102 to properly, securely, and functionally fit its designated firearm magazine well to lock in place and be released like the firearm's actual magazine while fully preventing the firearm from being fired.

Another embodiment features the magazine well block 102 and the base adapter 101 manufactured by 3D printing or from other hard materials such as carbon fiber, and fiberglass. The magazine well block 102 and the base adapter 101 may also be machined as one unibody design or two removably attachable pieces. The magazine well block 102 may also be skeletonized or hollow to be lighter in weight or for pure aesthetic purposes. The magazine well block 102 may also have a pocket, indentation, or raised area for a logo or marker anywhere on its body. The magazine well block 102 and the base adapter 101 may also have different colors, color patterns, and color schemes to match the user's preferences.

One or more embodiments features a base adapter 101 that removably attaches to any clamp or screw-type structure, preferably a photography/videography tripod at the top of the tripod where a camera is normally attached and secured. A firearm can then be attached and affixed fastened by inserting a compatible magazine well block 102, which has been specifically manufactured to be identically shaped and sized like an actual magazine for that firearm, into the magazine well 202 of that firearm. Once the firearm is secured onto the tripod the angular, horizontal, or vertical position of the firearm can be manipulated in any motion that is consistent with the movement capacity of the attached tripod. Additionally, once the firearm has been disassembled, the user can then perform hands-free maintenance and servicing, meaning that the user will not have to hold and carry certain parts to perform such maintenance or servicing and the user can focus using his or her hands on the actual maintenance and servicing of a firearm.

Figure 4A:
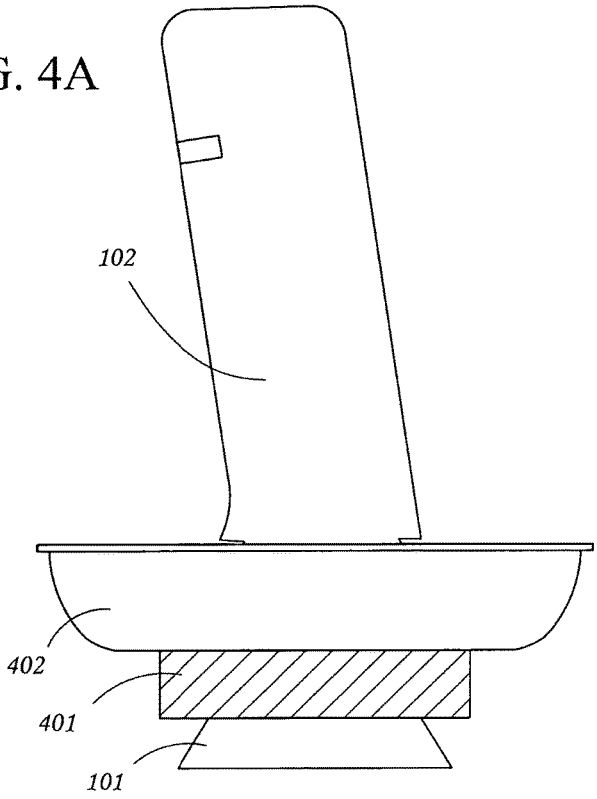
FIG. 4A shows a side view of a magazine well block and tripod adapter base with a magnetic container according to embodiments of the present disclosure.
Figure 4B:
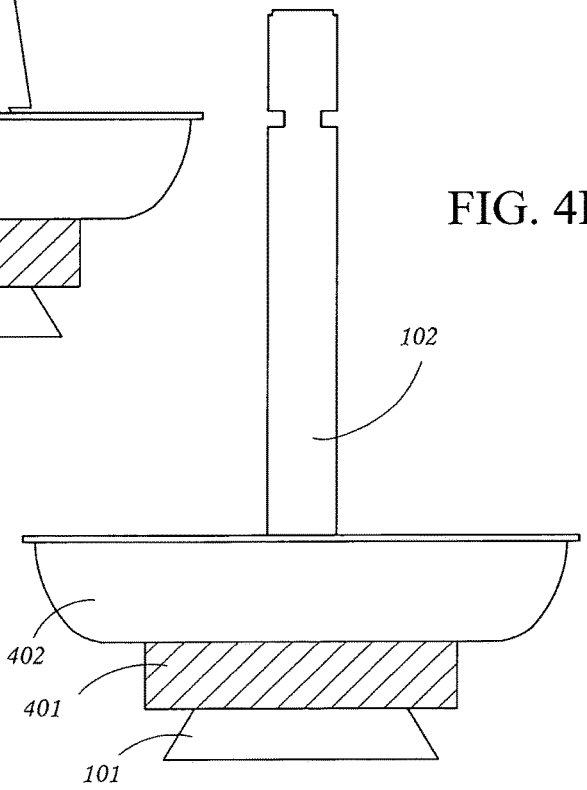
FIG. 4B shows a side view of a magazine well block and tripod adapter base with a magnetic container according to embodiments of the present disclosure.

FIG. 4A shows a side view of one or more non-limiting embodiments featuring the adapter base 101 and a magnetic container apparatus. FIG. 4B shows a front view of the same. The magnetic container device features a magnet 401 and a container such as a tray or a bowl and can be used to secure loose or disassembled metal parts, such as springs and pins, so the user can keep track of and not lose any of these parts during maintenance or servicing. One embodiment features a magnetic container apparatus with an open container 402 such as tray or bowl with a magnet 401 attached preferably beneath the open container 402 and between the adapter base 101 and container 402. The magnet 401 would attract, catch, or attach to loose or disassembled metal parts from the firearm and the container 402 such as tray or bowl would help secure the metal parts in place. One or more embodiments feature a container 402 tray or bowl made from either ferrous or non-ferrous metals. Other embodiments feature a container made of any non-metal material including polymer plastic and glass. The magnetic container apparatus may be separate or removable and attached to the adapter 101 and magazine well block 102 via screws or welding. In other embodiments, the magnet 401 and container 402 combination is machined as an extension of the adapter 101 so that the container 402 and the magazine well block 102 or the container 402 and the tripod adapter base 101 are of a unibody and nonseparable design. The container 402 may also feature a tray or bowl with non-circular shapes, such as squares, rectangles, and triangles, as well as various polygonal shapes and sizes to suit the user's needs and preferences. The magnet 401 may be attached on either side of a tray or either within or on the outer side of a container 402 such as bowl. Other embodiments feature a container 402 such as a mesh screen tray or a tray with slots, holes, and cavities shaped and sized to hold specific disassembled metal parts of the firearm for easier access and locating.

Figure 5:
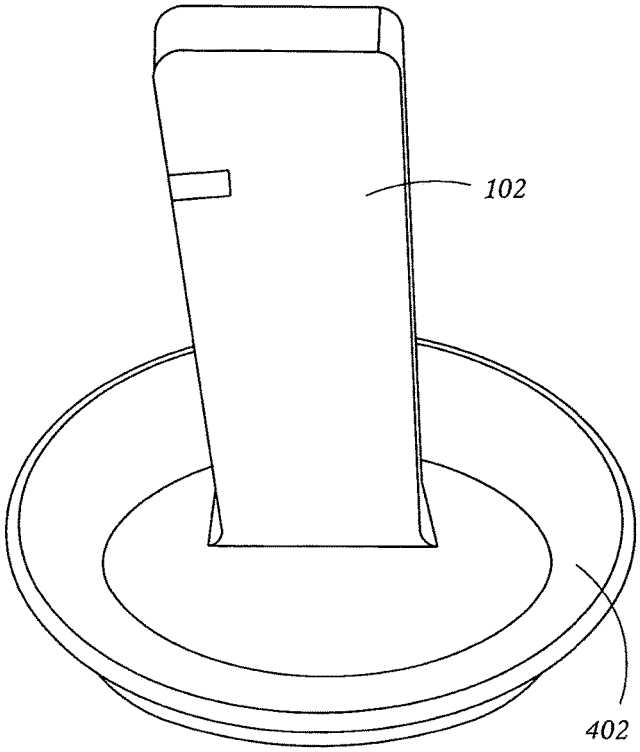
FIG. 5 shows an angular perspective view of a magazine well block and tripod adapter base with a magnetic container according to embodiments of the present disclosure.

FIG. 5 shows an angular perspective view of one of the embodiments featuring the magnetic container apparatus with a magazine well block 102 and a bowl shaped container 402.

A further embodiment features a universal adapter base to accommodate stands with different leg amounts such as unipods, bipods, or quadripods. Other embodiments feature an adapter base that do not use universal attachment mechanisms. This allows users who do not wish to use a traditional photography/videography tripods or stands to use the adapter system with non-traditional or alternative tripod or standing legged or non-legged base system. One such embodiment features an adapter base for a stakes and bars or one-legged, two-legged, or four or more-legged structures or ground interfacing leg(s) that are static or adjustable in length and removably securable in place by a stake, screw, bolt, or other fastening methods common in the art of by friction using rubber grommets or other compatible friction gripping materials attached as feet at the ends of the leg(s).

Another embodiment features an adapter base with a locking swivel component. This base can be attached to stationary or structural objects including tables, blocks, walls, and beams by screws, clamps, suction cups, adhesives, or any similar fastening means relevant in the art. The locking swivel mimics the omnidirectional movement of a tripod head, allowing the user to use the support and apparatus system even without a tripod.

A further embodiment features an electrical power or battery pack power supply system integrated into the base adapter to accommodate and supply electrical power to a plurality of electrical components such as an electrically wired/corded, USB connected and powered, or battery powered light system for working in the dark. The electrical power or battery system may also be removably attached and use disposable and rechargeable disposable batteries of a plurality of battery sizes, such as AA, AAA, or 9-volt dry-cell batteries, or use rechargeable batteries of a plurality of battery types such as lithium-ion. The battery system may also have a plurality of USB connectors to power different devices such as lights and computer systems. In other embodiments, the electrical power or battery system supplies power for a laser attachment for precision bore sighting. The laser attachment is coupled to the top of a magazine well block and can be situated like a chambered bullet. When this block with laser is engaged, the laser will point down the barrel aid with bore sighting.

One embodiment may feature an attachment system with attachment mechanisms to hold and secure various larger disassembled firearm components. One such system uses various clips to hold and secure various disassembled firearm components in place. This system may use circular clips that have a diameter proportionate to the diameter of the specific disassembled firearm component it is designed to hold, such as the barrel of a firearm. Other attachments including protective or concealing component such as camouflage nets and tarp to protect or conceal the tri-pod may be used. The attachment system attached to the protective or concealing component may be removably attached to the clamp or screw-type tri-pod adapter or attached as a unibody design to the clamp or screw-type tri-pod adapter of the present invention. Another system of this embodiment may have separate compartments to store or house the protective or concealing components such as camouflage nets and tarp when these components are not in use.

Figure 6A:
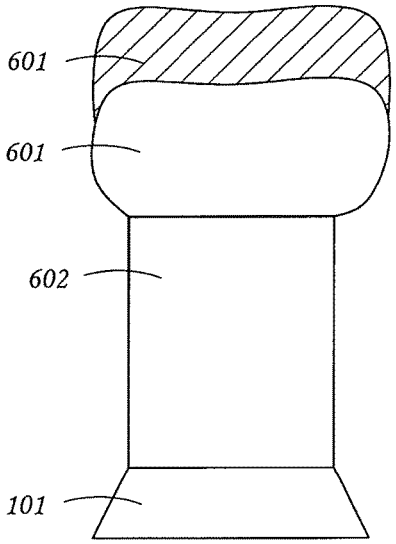
FIG. 6A shows a side view of a trigger cover and tripod adapter base with according to embodiments of the present disclosure.
Figure 6B:
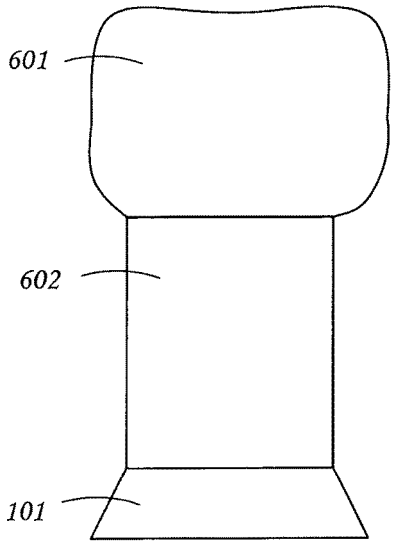
FIG. 6B shows another side view of a trigger cover and tripod adapter base with according to embodiments of the present disclosure.
Figure 6C:
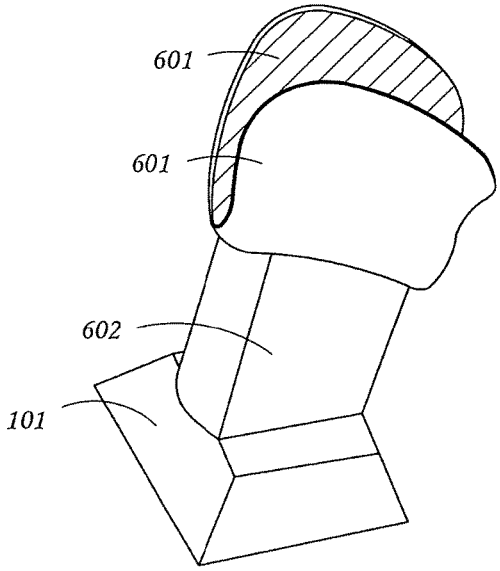
FIG. 6C shows an angular perspective view of a trigger cover and tripod adapter base with according to embodiments of the present disclosure.
Figure 6D:
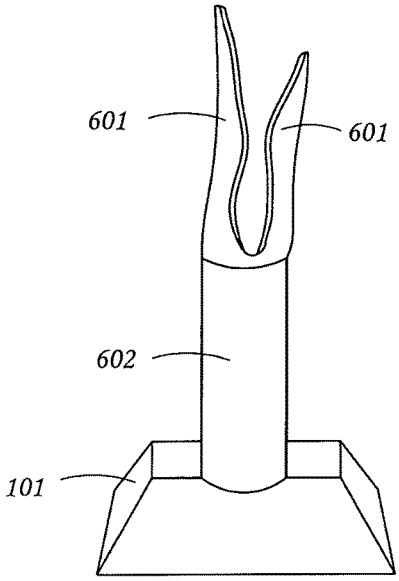
FIG. 6D shows a front view of a trigger cover and tripod adapter base according to embodiments of the present disclosure.
Figure 7:
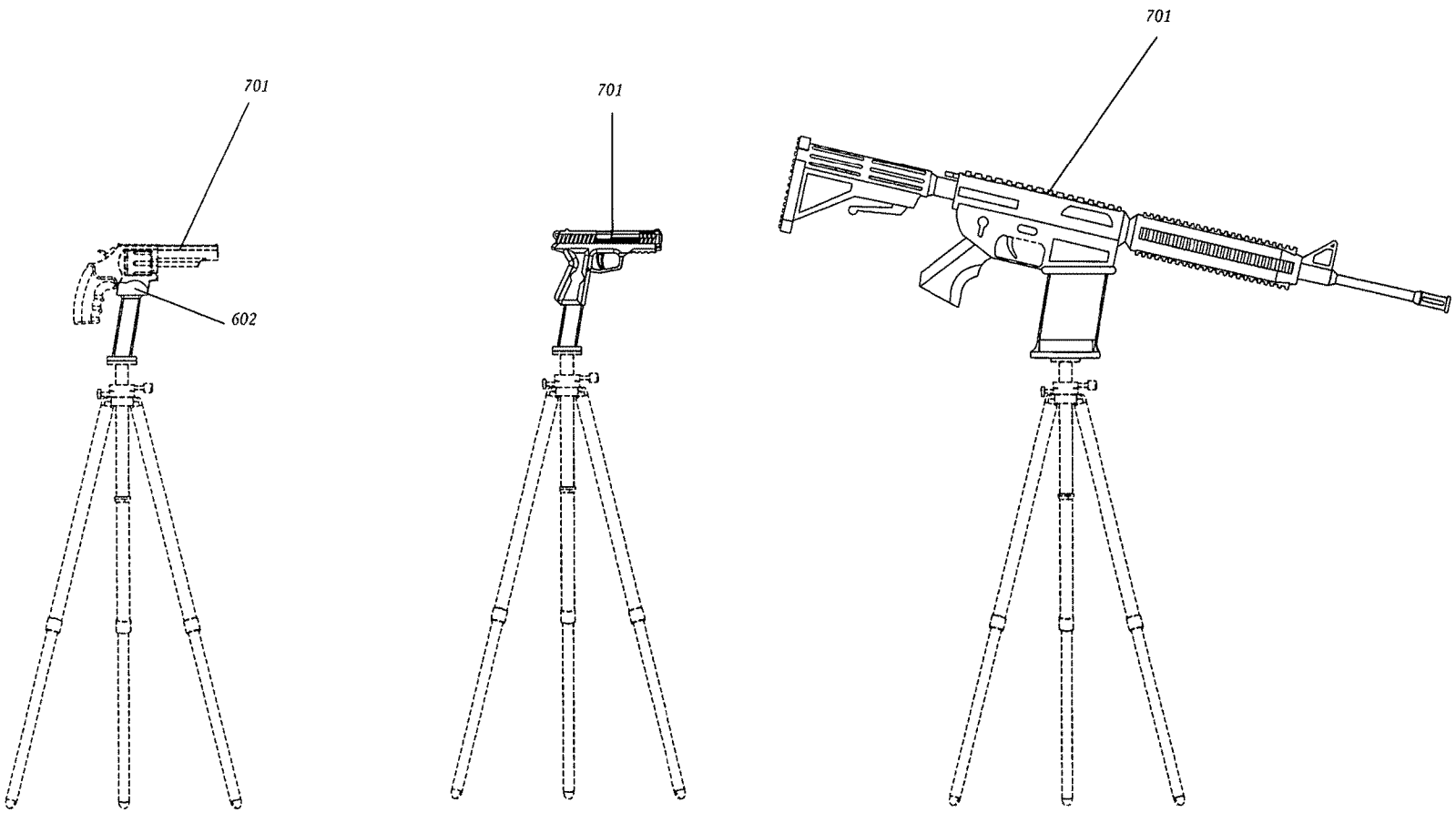
FIG. 7 shows a side view of the tripod adapter base and magazine well block attached to different firearms and a standing adjustable tripod according to the embodiments of the present disclosure.

FIGS. 6A and 6B show one or more embodiments which may feature an adjustable fastening device such as a trigger cover 601 integrally attached to a machined base block 602 and a photography/videography tripod adapter 101 to hold firearms that do not use removable magazines such as revolvers, bolt action rifles, lever action rifles, and shotguns. Different clamps, vice grips, loops, hooks, and other fasteners common in the art may be attached to a tripod adapter base to securely hold a plurality of non-magazine fed firearms but still maintain the versatility and portability of the present invention. The cover 601 may be a clamp or a cradle shaped to securely fit the trigger guard of these firearms.

One or more embodiments may feature a tripod adapter base with a trigger guard blocking attachment system attached to a magazine well block with an extended lower section that would extend past the base of the magazine well or handle or grip of said specified handgun. The extended lower section would include a trigger blocking extension with a trigger blocking component such as a folding clamp or two-pronged cradle molded or shaped to match said trigger guard that completely blocks access to the trigger as an additional protective element. The trigger blocking extension system may be removably affixed to the extended lower section of the magazine well block of a specified handgun or it may have a unibody design and integrally attached to the extended lower section. The trigger blocking extension system may use pliable and flexible materials such braided rope or cords, or use a non-flexible extended arm that is made from the same material used to machine or manufacture the magazine well block itself or comparable material common in the art.

While preferred and alternate embodiments have been illustrated and described, as noted above, many changes can be made without departing from the spirit and scope of the embodiments provided in the present disclosure. Accordingly, the scope of the embodiments provided in the present disclosure, is not limited by the disclosure of these preferred and alternate embodiments. Instead, the scope of the invention title be determined entirely by reference to the claims. Insofar as the description above and the accompanying drawings (if any) disclose any additional subject matter that is not within the scope of the claims below, the inventions are not dedicated to the public and Applicant hereby reserves the right to file one or more applications to claim such additional inventions.

All the features disclosed in this specification (including any accompanying claims, abstract, and drawings) may be replaced by alternative features serving the same, equivalent, or similar purpose, unless expressly stated otherwise. Thus, unless expressly stated otherwise, each feature disclosed is one example of a generic series of equivalent or similar features.

Any element in a claim that does not explicitly state "means for" performing a specified function, or "step for"

performing a specific function is not to be interpreted as a "means" or "step" clause as specified in 35. U.S.C. § 112 ¶6. In particular, the use of "step of" in the claims herein is not intended to invoke the provisions of U.S.C. § 112 ¶6.

What is claimed is:

1. A support adapter system for firearms, the system comprising:

a tripod adapter base for a photography or videography stand such as a tripod; and a magazine well block;

wherein the magazine well block comprises a block body;

wherein the block body comprises at least one relief cavity;

wherein the at least one relief cavity is identical to a relief cavity found on a functional firearm magazine;

wherein the block body comprises a solid, filled construction such that live ammunition cannot be loaded into the magazine well block and a firearm cannot be fired when said magazine well block is inserted into a magazine well of a firearm.

2. The system of claim 1, wherein the tripod adapter base comprises a screw-type adapter.

3. The system of claim 1, wherein the tripod adapter base comprises a clamp-type adapter.

4. The system of claim 1, wherein the block body comprises a skeletonized construction such that live ammunition cannot be loaded into the magazine well block and a firearm cannot be fired when said magazine well block is inserted into a magazine well of a firearm.

5. A support adapter system for firearms, the system comprising:

a tripod adapter base for a photography or videography stand such as a tripod;

a magazine well block;

a vessel; and a magnet;

wherein the magazine well block comprises a block body;

wherein the block body comprises at least one relief cavity;

wherein the at least one relief cavity is identical to a relief cavity found on a functional firearm magazine;

wherein the block body comprises a solid construction such that live ammunition cannot be loaded into the magazine well block and a firearm cannot be fired when said magazine well block is inserted into a magazine well of a firearm;

wherein the vessel comprises a ferrous metal;

wherein the magnet is attached between the vessel and the tripod adapter base such that the magnet magnetizes the vessel.

6. The system of claim 5, wherein the tripod adapter base comprises a screw-type adapter.

7. The system of claim 5, wherein the tripod adapter base comprises a clamp-type adapter.

8. The system of claim 5, wherein the block body comprises a skeletonized construction such that live ammunition cannot be loaded into the magazine well block and a firearm cannot be fired when said magazine well block is inserted into a magazine well of a firearm.

9. The system of claim 5, wherein the vessel comprises a bowl.

10. The System of claim 5, wherein the vessel comprises a tray.

* * * * *